US007227506B1

(12) United States Patent
Lewis, Jr.

(10) Patent No.: US 7,227,506 B1
(45) Date of Patent: Jun. 5, 2007

(54) LOW PROFILE DUAL FREQUENCY MAGNETIC RADIATOR FOR LITTLE LOW EARTH ORBIT SATELLITE COMMUNICATION SYSTEM

(76) Inventor: Donald Ray Lewis, Jr., 642 Sugar Creek Trail, Conyers, GA (US) 30208

( * ) Notice: Subject to any disclaimer, the term of this patent is extended or adjusted under 35 U.S.C. 154(b) by 0 days.

(21) Appl. No.: 09/391,267

(22) Filed: Sep. 7, 1999

Related U.S. Application Data

(63) Continuation-in-part of application No. 09/350,427, filed on Jul. 8, 1999, now Pat. No. 6,069,589.

(51) Int. Cl.
*H01Q 13/10* (2006.01)
*H01Q 1/38* (2006.01)

(52) U.S. Cl. ..... 343/767; 343/700 MS

(58) Field of Classification Search ..... 343/700 MS, 343/767, 770, 713, 872
See application file for complete search history.

(56) References Cited

U.S. PATENT DOCUMENTS 3,172,112 A * 3/1965 Seeley ..... 343/767
3,550,141 A * 12/1970 Harris et al. ..... 343/767
4,370,658 A 1/1983 Hill ..... 343/713
5,003,318 A 3/1991 Berneking et al. ... 343/700 MS
5,486,836 A 1/1996 Kuffner et al. ..... 343/700 MS
5,572,222 A 11/1996 Mailandt et al. ..... 343/700 MS
5,581,266 A * 12/1996 Peng et al. ..... 343/770
5,640,139 A 6/1997 Egeberg ..... 340/426
5,652,595 A 7/1997 Ahrens et al. ..... 343/700 MS
6,069,589 A * 5/2000 Lewis, Jr. et al. ..... 343/767

* cited by examiner

*Primary Examiner*—Tan Ho

(57) ABSTRACT

A dual-frequency antenna (100) includes a ground plane (105) that is substantially planar and a radiator (110) that is substantially planar and formed of a conductive material. A slot (115) having first and second ends is formed in the radiator (110), and first and second apertures (120, 125) are formed at the first and second ends, respectively, of the slot (115). The radiator (110) also includes transmission connections (140) for coupling to external transmission circuitry and receiving connections (130) for coupling to external reception circuitry. The transmission connections (140) and the receiving connections (130) are located along the slot and separated by a distance of approximately one-quarter wavelength. Preferably, the height of the antenna (100), i.e., the distance between the radiator (110) and the ground plane (105) is equal to or less than about 1.9 centimeters for low-profile mounting on truck-drawn trailers.

15 Claims, 4 Drawing Sheets

LOW PROFILE DUAL FREQUENCY MAGNETIC RADIATOR FOR LITTLE LOW EARTH ORBIT SATELLITE COMMUNICATION SYSTEM

RELATED PATENT APPLICATION

This patent application is a continuation-in-part of U.S. patent application Ser. No. 09/350,427 (attorney's docket number A-5793), filed on Jul. 8, 1999 by Lewis et al. U.S. Pat. No. 6,069,589 and assigned to the assignee hereof.

TECHNICAL FIELD

This invention relates in general to the field of antennas, and in particular to dual frequency, low profile magnetic antennas.

BACKGROUND

Little low earth orbit (LLEO) satellite systems provide low cost modems that communicate with satellites. These modems can be attached to customer assets such as trucks, trailers, train cars, shipping containers, etc. to give the customer the ability to track and monitor assets across the world. The modems typically communicate with the LLEO satellites via an antenna, which transmits and, when required, receives information from the satellite. Conventional designs for antennas for this application include only electrical antennas, which have relatively low radiation efficiencies and are relatively large in size in comparison with other some other types of antennas.

Modems for LLEO applications are generally installed within a truck or a truck-drawn trailer to protect the modem from damage, theft, and vandalism. The antenna, on the other hand, must be installed on the outside of the trailer to have visibility to the sky, but there is little clearance and little available space on the outside of the trailer, and most types of smaller antennas suffer from narrow bandwidths and low efficiency when mounted relatively close to a ground plane, which is the case for LLEO antennas mounted on trailers. Additional problems encountered for LLEO communication applications include the low elevation coverage required, the dual-frequency nature of the application, the desired non-intrusive features of the application, and cost considerations, to name but a few.

DETAILED DESCRIPTION OF A PREFERRED EMBODIMENT OF THE INVENTION

Figure 1:
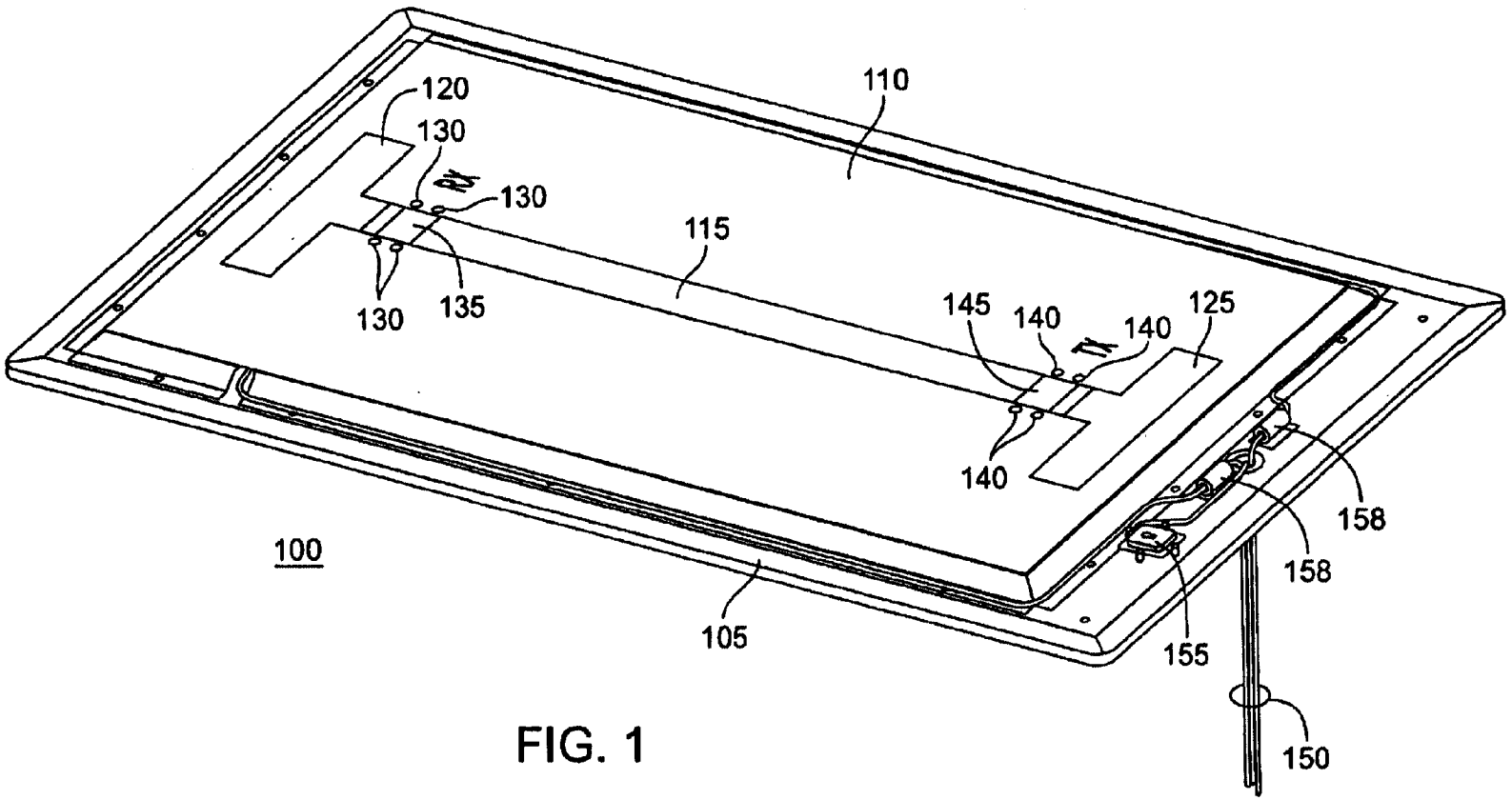
FIG. 1 is a top perspective view of an antenna comprising transmit and receive units and a ground plane and formed according to the present invention.

FIG. 1 is a perspective view of an antenna 100 for use in little low earth orbit (LLEO) satellite applications. The antenna 100 is a dual frequency slot antenna having a resonance frequency that is lowered by grounding the antenna at multiple points and by loading slot ends, thereby decreasing the antenna size. The antenna's dual-frequency nature is obtained by separating the transmit and receive connection points by a slot length of a quarter wavelength. Due to its low-profile nature, the antenna 100 can be mounted by trailer owners to the exterior of a truck-drawn trailer to minimize the likelihood of fear of vandalism, damage, and theft. Since the low profile of the antenna 100 makes it less noticeable, it is also likely that, if a trailer is stolen, the thief will not know to disable the modem or antenna that enables satellite tracking of the trailer.

The antenna 100 of the present invention features dual resonance frequencies in approximately one-quarter of the space required by equivalent electrical antennas or unloaded slot designs. The antenna's overall cavity height is also greatly reduced. Features of the antenna 100 include:

- Use of magnetic radiators for low profile inconspicuous conformal antennas for uplink and downlink communications. The use of a magnetic radiator, when located close to a metallic ground plane, provides a higher input impedance and a resulting increase in radiation efficiency as compared to a conventional electrical radiator. The use of a shortened magnetic radiator necessitates matching elements that provide capacitive reactance for matching as compared with electrical radiators which require inductive reactive matching. Capacitive matching elements inherently have lower losses than inductive elements, thereby increasing radiation efficiency.
- Increased bandwidth characteristics at both resonance frequencies when compared to equivalent electrical antennas.
- Reduced antenna volume utilizing slot end-loading techniques and short strips.
- Dual frequency, for example 137 MHz and 150 MHz, operation with a single element for both transmission and reception.
- Transmit-to-receive isolation of greater than 12 dB.
- An optional integrated Global Positioning System (GPS) patch.
- Thorough radiation pattern providing necessary coverage of satellite network or constellation.
- Wide bandwidth (6 dB return loss bandwidth>1.5 MHz) via superior matching across satellite frequencies.

The antenna 100 includes a radiator 110 and a ground plane 105 to which the transmitting and receiving radiator 110 is mechanically and electrically coupled by conductive fasteners that are distributed around the periphery of the radiator 110. Via holes 130 indicate one or more receiving terminals, i.e., locations at which electrical signals at the receiving frequency can be electrically coupled to external circuitry or devices 135. Other via holes 140 indicate transmitting terminals, i.e., locations at which electrical signals at the transmitting frequency can be electrically coupled to external circuitry or devices 145.

The radiator 110 and the ground plane 105 are formed from an electrically conductive material, such as aluminum or copper. The radiator 110 is coupled to a separate electronic device, such as an LLEO modem (not shown), by cables 150. The antenna 100 may include an optional Global Positioning System patch 155, in which case the patch 155 is also coupled to external circuitry by a cable 125. A smaller auxiliary magnetic slot antenna (not shown) may be cut in item 110 to provide Global Positioning System receive data.

The radiator 110, according to the present invention, form a loaded slot antenna. Therefore, the radiator 110 includes a slot 115 that is loaded by apertures 120, 125 formed in the radiator material at the respective ends of the slot 115. The slot 115 and apertures 120, 125 are sized and located appropriately for reception/transmission of desired frequencies, such as a transmission frequency of about 150 Mhz and a reception frequency of about 137 MHz. The slot distance between the transmission connection points 140 and the reception connection points 130 should be approximately one-quarter wavelength to provide isolation between the transmission and reception frequencies.

Figure 2:
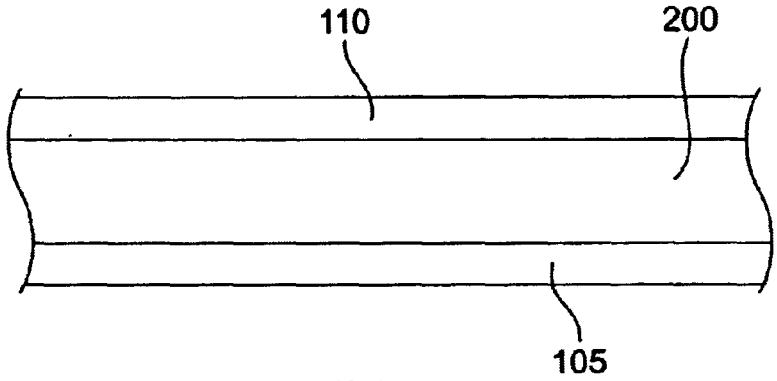
FIG. 2 is a side, cutaway view of the assembled antenna and ground plane of FIG. 1 according to the present invention.

Referring next to FIG. 2, a side, cutaway view of the antenna 100 is shown. When the antenna 100 is assembled, a foam spacer 200 holds the antenna radiator 110 a predetermined distance from the ground plane 105. The foam spacer 200 is formed from an electrically insulative material that provides minimal dissipative losses while still providing adequate mechanical support for the item 110 under severe vibrations, which often occur during transportation. The foam spacer 200 holds the radiator 110 at a distance of less than or equal to about 2.54 centimeters (cm) from the ground plane 105, and preferably at a maximum of about 1.9 cm from the ground plane 105, or less than 1/100 of a wavelength, thereby providing the needed low profile requirement for its application. In this manner, the antenna 105 can be formed into a low profile configuration suitable for mounting on a truck-drawn trailer. Additionally, the foam spacer 200 provides cushioning and mechanical integrity, which may be quite important for applications in which the antenna 100 is mounted to a moving vehicle, such as a truck-drawn trailer.

It will be appreciated that other types of insulative spacers could be used to replace the foam spacer 200. For example, a plurality of nonconductive fasteners (not shown), such as plastic rivets, could alternatively be inserted between the radiator 110 and the ground plane to mechanically secure the antenna 100.

Figure 3:
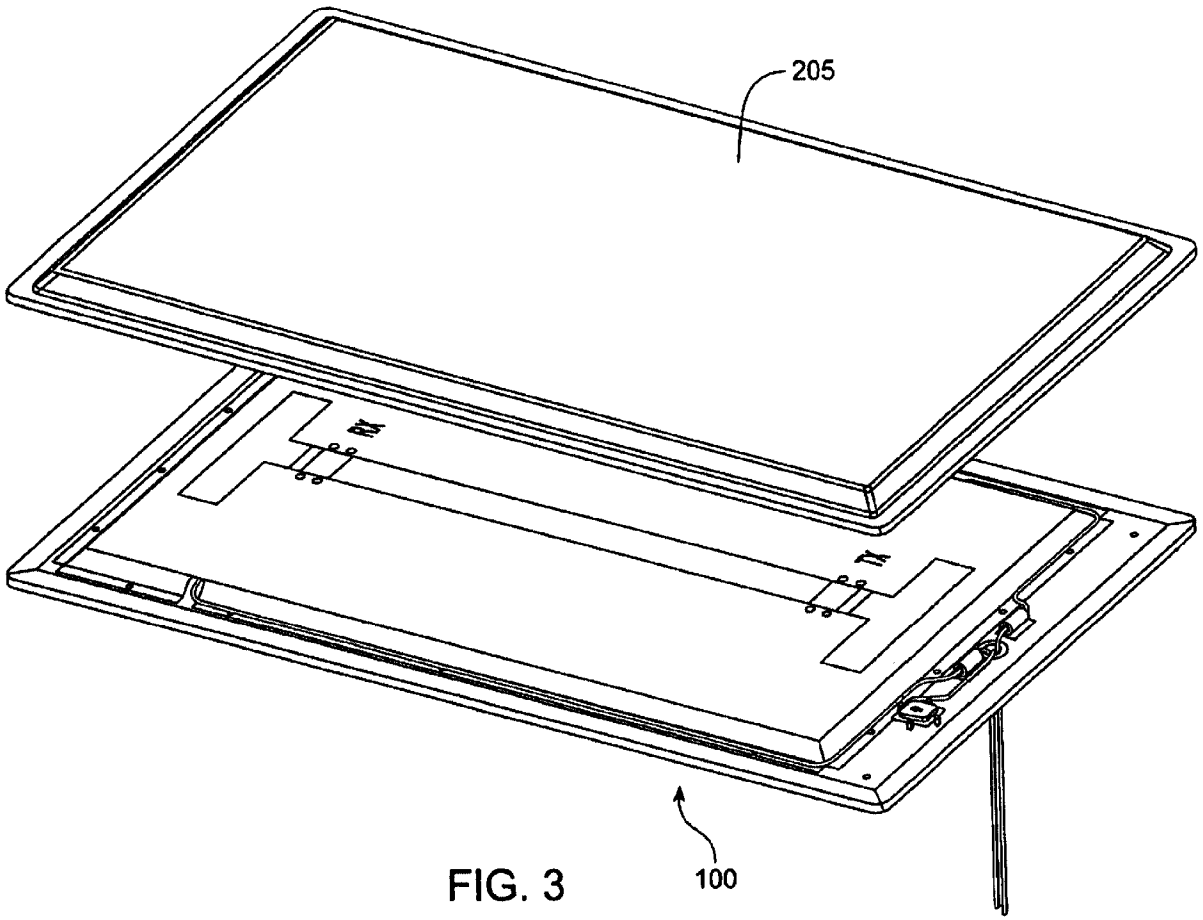
FIG. 3 is an exploded perspective view of the antenna of FIG. 1 and a protective radome according to the present invention.
Figure 6:
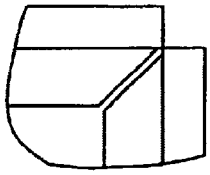
FIGS. 4–7 are diagrams specifying the mechanical details of the antenna of FIG. 1 according to the present invention.
Figure 7:
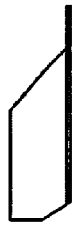
Figure 4:
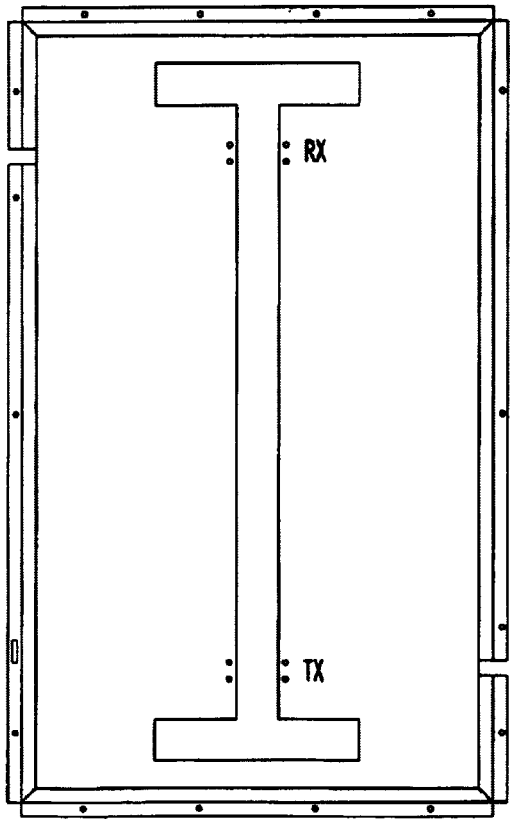
Figure 5:
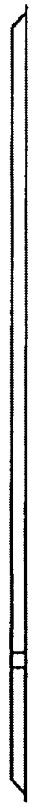

FIG. 3 is an exploded view of the antenna 100 and a protective radome 205. When the antenna 100 is mounted to a trailer, the radome 205 covers the antenna 100 and protects it from damage, such as that caused by rain, vandalism, or road debris. The radome 205 is formed from an electrically non-conductive material, such as plastic, and may be held to the antenna 100 by tape, glue, or another adhesive substance (not shown).

FIGS. 4–7 detail the mechanical dimensions of one antenna radiator 110 that was built and tested. The radiator 110 built according to the dimensions of FIGS. 4–7 received signals at approximately 137 MHz and transmitted signals at approximately 150 MHz. Because surface currents can spread over the relatively large surface area of the example radiator 110, the antenna 100 employing the radiator 110 exhibited little degradation in performance due to moisture, a desirable characteristic in situations in which the antenna 100 is exposed to rain and high humidity.

It will be appreciated by one of ordinary skill in the art that the dimensions set forth in FIGS. 4–7 for the radiator 110 of the antenna 100 can vary within certain tolerances without materially affecting antenna performance and can be substantially different for alternative transmit and receive frequencies. What is important is that the radiator 110 includes a loaded slot and that the slot distance between the receive and transmit connections be about one-quarter wavelength.

Figure 8:
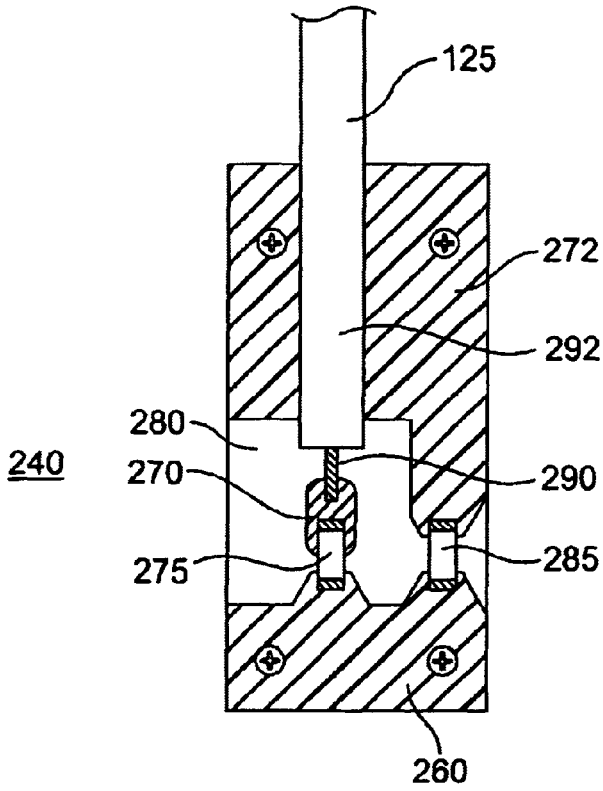
FIG. 8 is an illustration showing electrical and mechanical coupling to the antenna of FIG. 1 in accordance with the present invention.

FIG. 8 depicts the use of a substrate 240 that is electrically coupled to each of the receive connections 130 (FIG. 1) and the transmit connections 140 to transmit signals therefrom and thereto, respectively. The substrate 240 includes a first conductive region 260 formed, for example, by plating a conductive material onto the substrate 240 and second and third conductive regions 270, 272 that can be formed in similar manner. On the substrate 240, the conductive regions 260, 270, 272 are electrically insulated from each other by a nonconductive region 280 for electrically isolating each conductive region 260, 270, 272.

A first capacitor 275, such as a 2.0 to 2.5 picofarad (pf) capacitor, is electrically coupled, such as by soldering, between the first and second conductive regions 260, 270. Since the capacitor 275 is mounted over the nonconductive region 280 of the substrate 240, it is advantageously protected from breakage by the additional mechanical support provided by the nonconductive region 280. A second capacitor 285, such as a 19 to 23 pf capacitor, is electrically coupled between the first conductive region 260 and the third conductive region 272. The first conductive region 260 of the substrate 240 is coupled to a first side of the slot 115 (FIG. 1) of the radiator 110, and the third conductive region 272 is coupled to the radiator 110 at the opposite side of the slot 115.

An electrical cable 125 can be electrically coupled, such as by soldering, to the substrate 240 for routing signals from external circuitry (not shown) to the radiator 110 of the antenna 100. More specifically, when a coaxial cable is used, the center conductor 290 is electrically coupled to the second conductive region 270, and the outer conductor 292 is electrically coupled to the third conductive region 272. In this manner, signals are capacitively coupled from the first conductive region 260 to the cable 125. One or more choke baluns (reference numbers 158 in FIG. 1) can be mounted around the cables 125 to present a high impedance to current on the outside of the cables 125, thereby choking off these currents.

Although the example antenna 100 described herein includes a ground plane 105, it should be understood that the ground plane 105 could be eliminated entirely when a surface of a truck-draw trailer to which the antenna 100 is mounted is suitable for use as the ground plane. In such a circumstance, a spacer (such as a foam insert) could be used to hold the radiator 110 away from the electrically conductive portion of a trailer that is to be used as a ground plane, and rivets or other conductive fasteners could be used to electrically couple the radiator 110 to the trailer at appropriate locations.

According to the present invention, the antenna 100 could also be embedded into the truck trailer so that its appearance is not noticeable and to further reduce both the profile of the antenna 100 and performance degradation due to environmental concerns. Alternatively, the antenna 100 could be disguised in other manners, such as by manufacturing a protective radome or cover that is similar in appearance to other common and inexpensive trailer items, such as wind baffles or air dams. In this manner, the likelihood of theft or vandalism can be minimized without affecting antenna performance.

According to the present invention, the dual-frequency magnetic radiator described above has significant advantages in comparison with prior art antennas typically used in little low earth orbit satellite applications. In particular, the use of a magnetic antenna provides efficient radiation when located in close proximity to a metallic ground plane, such as a truck-drawn trailer, and the use of slot loading in the manner described above minimizes the area required for antenna resonance. Other advantages include significant reduction in the aperture area required for the radiator as a result of use of the described shorting pins, suppression of radiation from the coaxial cable as a result of the integral current balun, and insignificant performance degradation due to exposure to moisture. Because dual antenna elements are configured to minimize cross-coupling, there are minimal filtering requirements for the attached transceiver. Also, the use of low loss capacitive matching increases antenna gain as compared with typical matching circuits that utilize higher loss inductive matching elements.

While preferred embodiments of the present invention have been illustrated and described, it will be appreciated that the invention is not so limited. Numerous modifications, changes, variations, substitutions, and equivalents will occur to those skilled in the art, and such modifications, changes, variations, substitutions, and equivalents are not considered to depart from the spirit and scope of the present invention as defined by the below claims.

What is claimed is:

1. A dual-frequency antenna, comprising:

a ground plane that is substantially planar; and a radiator that is substantially planar, formed of a conductive material, and coupled to the ground plane, the radiator having formed therein a slot having first and second ends, a first aperture formed at the first end of the slot, and a second aperture formed at the second end of the slot, the radiator comprising a transmitting terminal and a receiving terminal formed along the slot and separated by a distance of approximately one-quarter wavelength.

2. The dual-frequency antenna of claim 1, wherein the conductive material is copper.

3. The dual-frequency antenna of claim 1, wherein the conductive material is aluminum.

4. The dual-frequency antenna of claim 1, wherein:

the ground plane is substantially parallel to a plane in which the radiator is held.

5. The dual-frequency antenna of claim 4, wherein the ground plane is held a predetermined distance from the radiator.

6. The dual-frequency antenna of claim 5, further comprising:

conductive fasteners for electrically coupling the radiator to the ground plane; and a spacer for holding the ground plane the predetermined distance from the radiator.

7. The dual-frequency antenna of claim 6, wherein the spacer comprises a foam spacer.

8. The dual-frequency antenna of claim 6, wherein the ground plane comprises a portion of an external vehicle to which the dual-frequency antenna is mounted.

9. The dual-frequency antenna of claim 1, further comprising:

a radome for covering the radiator.

10. The dual-frequency antenna of claim 9, wherein the radome is formed from an electrically insulative material.

11. The dual frequency antenna of claim 1, further comprising:

a substrate mounted to the radiator for transmitting electrical signals to the radiator from an external device.

12. The dual-frequency antenna of claim 11, wherein the substrate comprises:

a first conductive region coupled to a region on a first side of the loaded slot of the radiator; and a second conductive region coupled to a region on a second side of the loaded slot, opposite the first side, of the radiator;

a nonconductive region separating the first conductive region and the second conductive region; and a capacitor electrically coupled between the first conductive region and the second conductive region.

13. The dual-frequency antenna of claim 1, wherein the radiator is configured to transmit radio frequency signals of about 150 MHz.

14. The dual-frequency antenna of claim 1, wherein the radiator is configured to receive radio frequency signals of about 137 MHz.

15. A dual-frequency antenna, comprising:

a ground plane that is substantially planar; and a radiator that is substantially planar, formed of a conductive material, and coupled to the ground plane, the radiator having formed therein a slot having first and second ends, a first aperture formed at the first end of the slot, and a second aperture formed at the second end of the slot, the radiator comprising a transmitting terminal and a receiving terminal formed along the slot and separated by a distance of approximately one-quarter wavelength, wherein the distance between the ground plane and the radiator is less than or equal to about 2.54 centimeters.

* * * * *